US005660148A

United States Patent [19]

Raiko

[11] Patent Number: 5,660,148

[45] Date of Patent: Aug. 26, 1997

[54] METHOD AND DEVICE IN THE COOLING OF THE CIRCULATING MATERIAL IN A FLUIDIZED-BED BOILER

[75] Inventor: Markku Raiko, Hyvinkää , Finland

[73] Assignee: Imatran Voima Oy, Helsinki, Finland

[21] Appl. No.: 199,263

[22] PCT Filed: Sep. 9, 1992

[86] PCT No.: PCT/FI92/00238

§ 371 Date: Feb. 24, 1994

§ 102(e) Date: Feb. 24, 1994

[87] PCT Pub. No.: WO93/05340

PCT Pub. Date: Mar. 18, 1993

[30] Foreign Application Priority Data

Sep. 12, 1991 [FI] Finland ..... 914299

[51] Int. Cl.[6] ..... F23C 11/02

[52] U.S. Cl. ..... 122/4 D; 110/245

[58] Field of Search ..... 110/245; 122/4 D

[56] References Cited

U.S. PATENT DOCUMENTS

| | | | |
|---|---|---|---|
| 4,419,965 | 12/1983 | Garcia-Mallol et al. | 122/4 D |
| 4,453,497 | 6/1984 | Davis | 122/4 D |
| 4,766,851 | 8/1988 | Emsperger et al. | 122/4 D |
| 4,852,345 | 8/1989 | Greis | 60/39.464 |
| 4,896,631 | 1/1990 | Holm et al. | 110/245 |
| 4,981,111 | 1/1991 | Bennett et al. | 110/245 |
| 5,044,287 | 9/1991 | Furukawa et al. | 110/346 |
| 5,086,715 | 2/1992 | Burgin et al. | 110/342 |
| 5,339,774 | 8/1994 | Tang | 122/4 D |
| 5,481,063 | 1/1996 | Hiltunen et al. | 110/342 |

FOREIGN PATENT DOCUMENTS

| | | |
|---|---|---|
| 8813506 | 10/1988 | Australia . |
| 0286845 | 10/1988 | European Pat. Off. . |
| 821986 | 12/1983 | Finland . |
| 834505 | 6/1984 | Finland . |
| 3107355 | 9/1982 | Germany . |
| 3623177 | 1/1988 | Germany . |
| 460147 | 9/1988 | Sweden . |
| 8101873 | 7/1981 | WIPO . |

*Primary Examiner*—Marguerite McMahon

*Attorney, Agent, or Firm*—Steinberg, Raskin & Davidson, P.C.

[57] ABSTRACT

The invention concerns a method and a device in the cooling of the circulating material in a fluidized-bed boiler. In the method the fuel (A) is introduced into the circulating-powder combustion chamber (10) of the fluidized-bed boiler into the lower part of the circulating-powder combustion chamber (10) and an inert circulating material, which contains a proportion of unburned powdered fuel (A), is circulated from the top part of the circulating-powder combustion chamber (10) to the lower part of the circulating-powder combustion chamber (10). The flue gases are passed in the method from the powder separator (13) along the duct (15) into the exhaust-gas boiler (16), through whose heat exchanger (16a) thermal energy of the flue gases is transferred further to other useful use. In the method, part of the cooled flue gases are recirculated along the duct (20) into the circulating material and, by means of the cooled flue gases, the capacity of cooling of the fluidized-bed furnace is regulated by affecting the temperature of the circulating material.

11 Claims, 5 Drawing Sheets

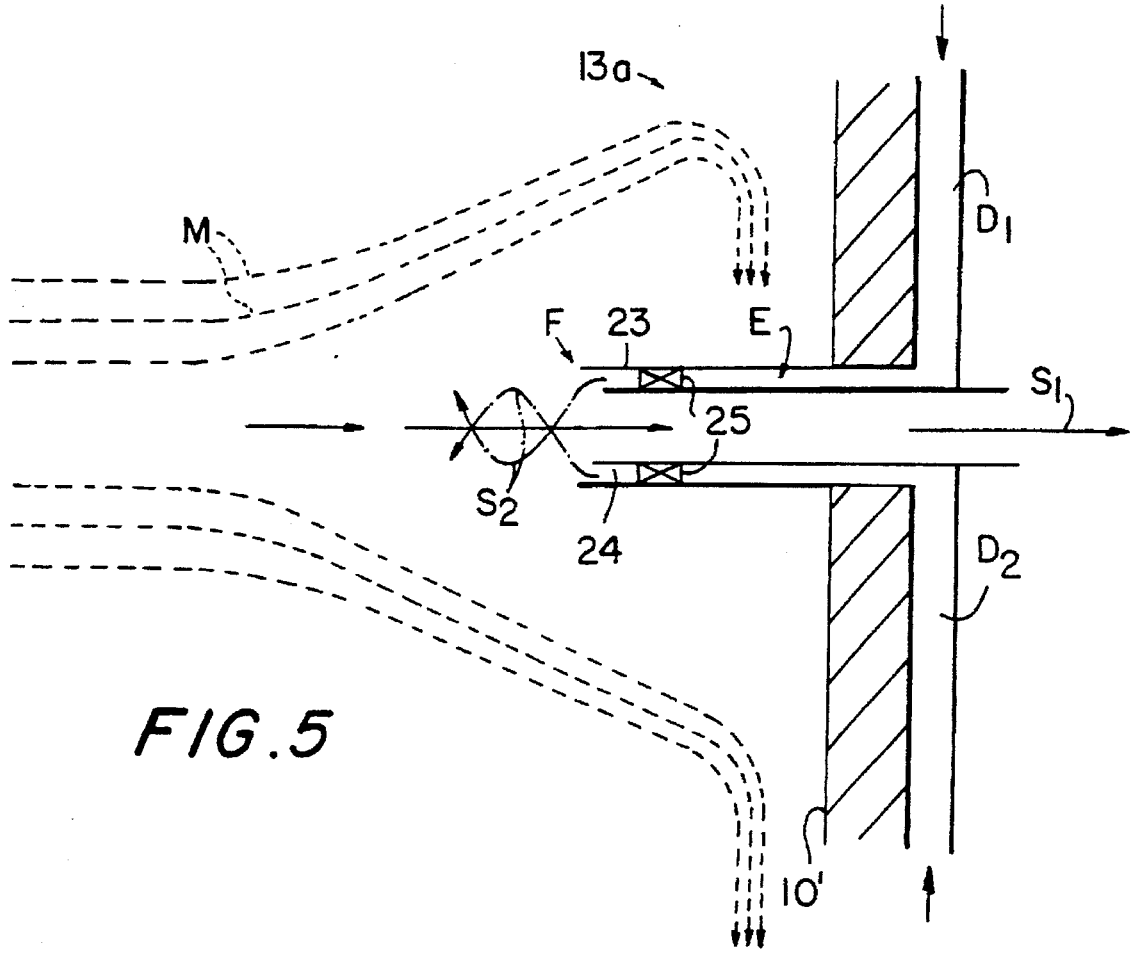
FIG. 5
FIG. 6
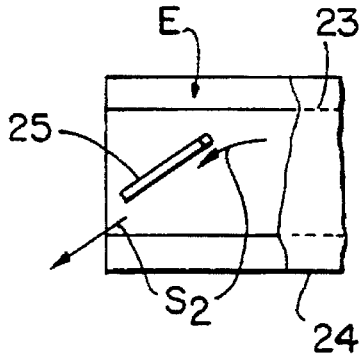

METHOD AND DEVICE IN THE COOLING OF THE CIRCULATING MATERIAL IN A FLUIDIZED-BED BOILER

FIELD OF THE INVENTION

The invention concerns a method and a device in the cooling of the circulating material in a fluidized-bed boiler.

BACKGROUND OF THE INVENTION

In fluidized-bed boilers based on the circulating-powder technique, the mass ratio of circulating powder to flue gases is typically 20:1 to 50:1. An abundance of powder equalizes the temperature profile of the furnace in a circulating-powder boiler quite efficiently even though the combustion takes place mainly in the lower part of the furnace and the cooling in the upper parts. The difference between the maximal and minimal temperatures in the circulation circuit is, at the maximum, 100 K.

The capacity of cooling of the furnace of a circulating-powder boiler is typically 30% to 50% of the total capacity of the boiler. As a rule, the cooling of the furnace has been accomplished by means of membrane heat-exchanger faces placed on the walls of the furnace and protected by a thin protective masonwork. The shield is needed because of erosion caused by the powder and because of corrosion caused by the reducing conditions. Tube packages can be placed in the upper part of the furnace, where they do not have to be protected, because in the upper part the conditions are oxidizing and the risk of corrosion is no longer as high as in the combustion zone.

Lowering of the capacity of cooling of the furnace of a circulating-powder boiler is problematic in fluidized-bed combustion. Lowering of the temperature in the furnace can hardly be used for regulation, because then the conditions of combustion would become unfavorable.

Prior-art solutions for regulation of the capacity of cooling of the furnace include the following modes of cooling:

The regulation of the capacity of cooling of the furnace takes place so that the quantity of circulating powder is affected by means of the distribution of air for the furnace. The quantity of circulating powder affects the heat-transfer coefficient. If the furnace is not cooled, the temperature will rise up to 1500° C. and the ashes will melt. In such a case, the fluidization of the circulating material in the reactor is disturbed. If the fluidization is disturbed, the combustion in the reactor is also disturbed.

For regulation of the capacity of cooling of the furnace, the method has also been used in which the hot circulating material that was separated in the powder separator after the furnace is recirculated directly into the combustion chamber. The circulating material has been cooled by means of separate heat-exchanger faces before returning into the combustion chamber. The heat-exchanger faces are placed in a separate fluidized bed, into which all or part of the hot circulating material is passed and from which the cooled circulating material is returned into the combustion chamber. The fluidization air of the separate fluidized bed is passed to the circulating-powder boiler as secondary air.

In the prior-art solutions, the dimensioning of the furnace cooling and the operation of the boiler with the use of fuels of different qualities have proved quite problematic even for the most experienced boiler manufacturers.

Along with the power level, the conditions of combustion in circulating-powder boilers have changed so extensively that optimal conditions for the removal of sulphur and nitrogen cannot be maintained within the entire capacity range.

The cooling of the circulating material by means of heat-exchanger faces is problematic because of particle erosion, corrosion, and increased costs.

Moreover, the sealing up of the power ranges of fluidized-bed boilers has proved difficult, because, owing to the internal circulation of material inside the furnace, the density of the circulating material on the furnace walls cannot be predicted precisely. This is why dimensioning of the heat-exchanger faces has not been successful.

The use of combustion air for regulation of the mount of circulating material and for regulation of the heat transfer has deteriorated the conditions of combustion in the lower part of the reactor and lowered the efficiency of the sulphur removal and of the combustion.

OBJECTS AND SUMMARY OF THE INVENTION

In the present application, attempts have been made to find a solution for the problems mentioned above.

The basic idea of the invention is separation of the combustion in the furnace of the circulating-powder boiler and of the heat transfer from one another so that the cooling of the furnace is carried out exclusively or partially by means of cold circulating gases taken from the final part of the boiler. In the solution in accordance with the invention, the circulating gases are not mixed into the combustion air, but these gases are used for the cooling of the inert circulating material in the circulating-powder combustion process.

Owing to the mixing of the circulating gases, the temperature of the flue gases is lowered little, because, at the mixing point, there is an abundance of circulating powder, whose thermal capacity is multiple as compared with the flue gases.

The circulating gases may be passed from several points into the space between the fluidized bed in the furnace and the powder separator. By changing the point of introduction of the circulating gases into the boiler, it is possible to regulate the amount of circulating material if desired.

The taking of the flue gases to recirculation takes place in a steam boiler favorably from between the economizer and the heat exchanger, but they may also be taken after the heat exchanger or after the filtering of the flue gases. It is essential that the circulating gases have been cooled by means of convection heat-exchanger faces so that the temperature of the flue gases is low enough when part of the flue gases are passed to recirculation.

The fluidized-bed reactor may be any prior-art circulating-material reactor with a single-draft or multi-draft reactor part, the essential feature being that the circulating material must have a sufficiently high consistency.

The invention can be applied both to new fluidized-bed boilers and to existing fluidized-bed boilers as a novel mode of regulation. When a boiler has been dimensioned for peat fuel and it is also desirable to bum coal in the plant with full capacity, this can be accomplished by means of partial use of circulating gas in accordance with the invention.

In one embodiment of the invention, the fluidization part, i.e. the reactor, and the cyclone used for separation of the powder have been combined as one device. The top part of the reactor has been constructed as a cyclone of circular section, into which the powder-containing gases enter from below. The powder-containing gas is brought into a revolving movement by means of secondary gas blown tangentially into the top part of the reactor. Thus, in the top part, a cyclone separator is formed, in which the powder is separated onto the walls of the reactor. The thick powder suspension formed on the faces of the walls flows along the walls of the reactor, in a non-fluidized state, into the lower part of the reactor. The circulating powder that has been returned into the lower part of the reactor is mixed with the rest of the bed material in the furnace. The clean gas is removed from the top part of the reactor through the axial central pipe. In this embodiment of the invention, the secondary gas is preferably the purified exhaust gas, which has been removed from the reactor, which has been cooled by means of the convection heat-exchanger faces of the boiler, and which is passed back into the reactor. By regulating the quantity of the secondary gas, it is possible to regulate the capacity of cooling of the whole furnace continuously.

The method in accordance with the invention for cooling of the circulating material in a fluidized-bed boiler is mainly characterized in that in the method part of the cooled flue gases are recirculated into the circulating material and, by means of the cooled flue gases, the capacity of cooling of the fluidized-bed furnace is regulated by affecting the temperature of the circulating material, and that in the method the recirculated gases are passed to the powder separator or to the front side of same, seen in the flow direction of the flue gases, and that the recirculated gases are passed to a point in the cycle of the circulating material from which they are not mixed with the combustion air and, thus, do not participate in the combustion process.

The device in accordance with the invention for cooling of the circulating material in a fluidized-bed boiler is mainly characterized in that there is a feedback duct through which the cold flue gases are recirculated into the inert circulating material in the circulating-powder chamber, and that in the solution of equipment the feedback duct is passed to the powder separator or to the front side of same, seen in the direction of circulation of the flue gases, and to a point from which the circulating gases are not mixed with the combustion air, whereby, thus, the circulating gases do not participate in the combustion process.

The passing of the circulating gases into the circulating material provides a number of advantages:

- the whole of the combustion zone is oxidizing and at the desired temperature, for which reason the combustion, the removal of sulphur, and the removal of nitrogen are intensified because of the optimal conditions;
- the cooling of the reactor can be accomplished efficiently, accurately and advantageously;
- the costs of the use of circulating gas are favourable because of the low loss of pressure in the powder separator and on the convection faces as compared with the overall pressure losses in the reactor;
- the mode of regulation is easy and accurate. Optimal conditions of combustion can be maintained even under extreme conditions, because the regulation of the capacity of cooling of the reactor is based on the amount of circulating gas, and combustion air can be used freely in accordance with the requirements of the combustion;
- the range of regulation is wide;
- the dimensioning of the boiler is easy, because the reactor produces a gas of invariable temperature, and the capacity obtained from the convection heat-exchanger faces depends on the gas quantity alone;
- the amount of circulating material can be increased without limitation, in which case either the reactor becomes smaller than the prior-art solutions or the maximal output obtained from reactor units of the present size is increased;
- the masonry work in the reactor can be made of more durable materials, because the heat transfer does not have to be taken into account;
- all the heat-exchanger faces can be placed in the secondary draft as convection faces. If the separation of powder is accomplished in two stages, it is possible to use higher gas velocities and advantageous ribbed tubes as heat transfer faces, i.e. the heat-exchanger faces would be of the same type as in the exhaust-gas boilers of gas turbines.
- it is possible to manufacture a boiler out of prefabricated modules;
- large boilers may comprise one common convection-duct-part and one steam circuit and a number of reactors;
- scaling from one size category to the other is easier, because the combustion unit can be dimensioned without requirements of heat transfer;
- unmanned operation of small heating boilers becomes possible because of the efficient principle of regulation;
- when an embodiment of the invention is employed in which the powder separator has been formed as a cyclone in connection with the reactor, for example, the following advantages are obtained:
- the sets of equipment of the circulating-powder fluidized-bed technique become simpler, and the cost of manufacture is lowered substantially;
- it is easy to regulate the amount of circulating powder in the reactor by means of the amount of secondary gas or by means of the nozzle speed, in which case it is also possible to regulate the magnitude of the charting residue in the fluidized-bed furnace accurately;
- when cold secondary gas is passed into the cyclone, it is possible to cool the fluidized-bed furnace efficiently. By varying the amount of flue gas, it is possible to regulate the capacity of cooling of the furnace continuously.

BRIEF DESCRIPTION OF THE DRAWINGS

The invention will be described in the following with reference to the embodiments of the invention illustrated in the figures in the accompanying drawings, the invention being, however, not supposed to be confined to these embodiments alone.

FIG. 5 is a separate illustration on an enlarged scale of one powder separator unit of the powder separator shown in FIG. 4.

FIG. 6 shows the construction between the separator pipes in the powder separator unit.

DETAILED DESCRIPTION OF THE INVENTION

Figure 1:
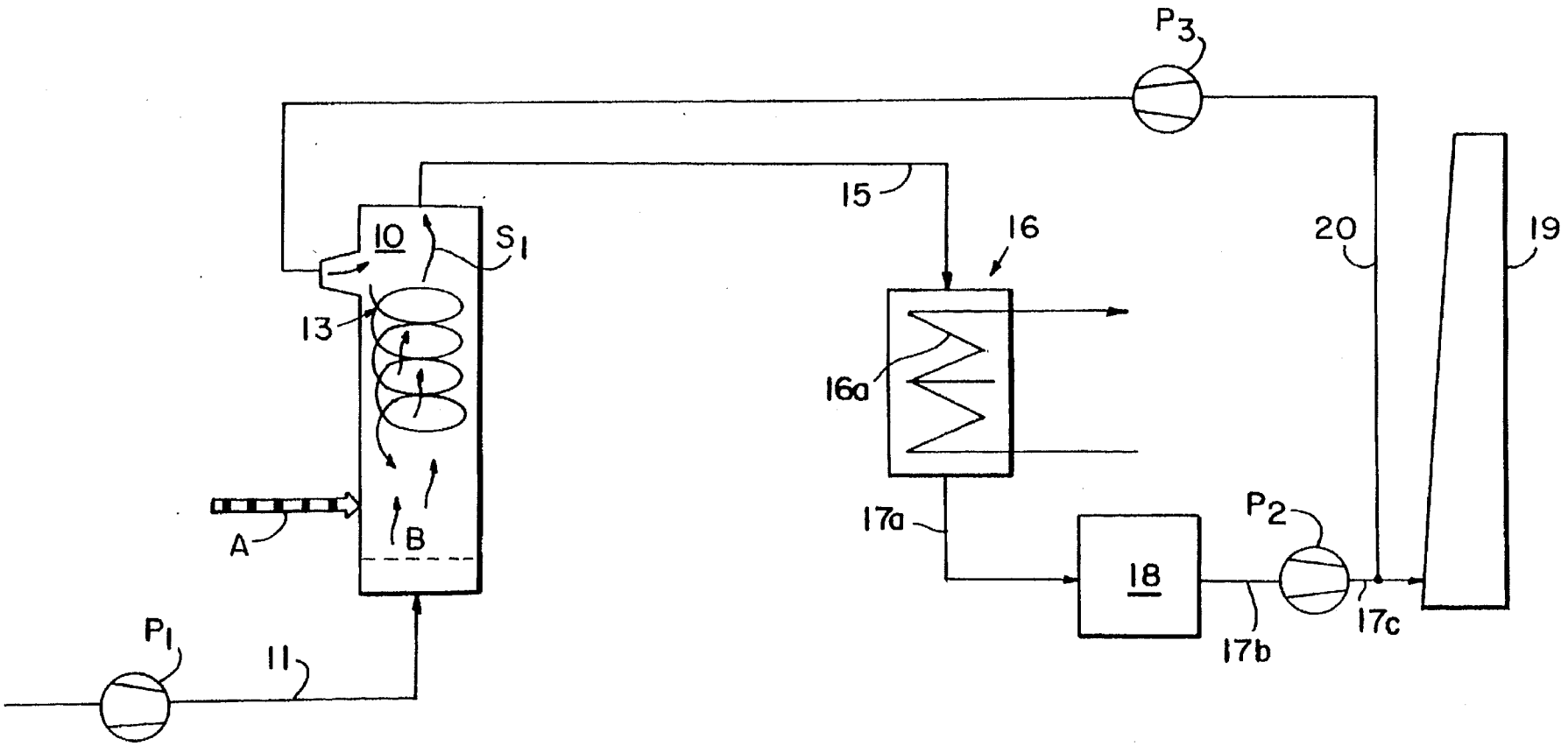
FIG. 1 is a schematic illustration of a first preferred embodiment of the method and the equipment in accordance with the invention.

In the way shown in FIG. 1, the fuel A for the circulating-powder combustion chamber 10 of the fluidized-bed boiler is passed into the lower part of the circulating-powder combustion chamber 10. The air needed for the combustion is also passed into the lower part of the circulating-powder combustion chamber 10 by means of the blower device $P_1$ through the duct 11.

The fluidization part of the circulating-powder combustion chamber, i.e. the reactor, is constructed as one device with the powder separator 13. The top part of the reactor is constructed as a cyclone of circular section, into which the powder-containing gases arrive from below. The powder-containing gas is brought into a rotatory movement by means of secondary gas blown tangentially into the top pan of the reactor. Thus, in the top part, a cyclone separator is formed, in which the powder is separated onto the walls of the reactor. The thick powder suspension formed on the wall faces flows along the reactor walls in a non-fluidized state into the lower part of the reactor. The circulating powder that has returned into the lower part of the reactor mixed with the rest of the bed material in the combustion chamber. The pure gas is removed from the top part of the reactor through the axial central pipe.

In this embodiment of the invention, the secondary gas that is used is the purified exhaust gas removed out of the reactor, whose pressure is raised by means of a blower to the pressure level required by the nozzles. In this embodiment of the invention, the secondary gas consists of exhaust gas cooled on convection heat-exchanger faces of the boiler, which gas, thus, cools the reactor.

By means of the invention, it has been possible to simplify the equipments of the circulating-powder fluidized-bed technique as compared with the prior-art equipments. The cost of manufacture of the equipments is favourable as compared with the prior-art equipments. The amount of circulating powder in the reactor can be regulated easily by means of the amount of secondary gas or by means of the nozzle speed. This is an important property, for example, when it is desirable to regulate the magnitude of the charring residue in a fluidized-bed furnace.

By means of cold secondary gas, it is possible to cool a fluidized-bed furnace efficiently. When flue gas that has been cooled on convection heat-exchanger faces is used as secondary gas, the capacity of cooling of the furnace can be regulated continuously by varying the amount of gas concerned.

From the top part of the circulating-powder combustion chamber 10, from the powder separator 13, the flue gases are passed along the duct 15 into an exhaust-gas boiler 16, in whose heat exchanger **16*a* a heat transfer liquid, preferably water, is circulated. Thus, by means of the heat exchanger 16*a*, the thermal energy of the exhaust gases is transferred into the liquid circuit of the heat exchanger 16*a*** and further, through the liquid circulation, out of connection with the boiler to useful use.

From the outlet side of the exhaust-gas boiler 16, a duct **17*a* passes to a filter 18. From the filter 18, a duct 17*b* passes to a blower $P_2$. From the blower $P_2$, from its outlet side, a duct 17*c* passes to the chimney 19**.

From the duct **17*c*, according to the invention, a duct 20 is passed as feedback to the powder separator 13 placed in the top part of the circulating-powder combustion chamber 10**.

Thus, in the solution in accordance with the invention, the capacity of cooling of the furnace of the circulating-powder combustion chamber is regulated by cooling the circulating material in the circulating-powder combustion chamber by means of cold circulating gases taken from the final part of the boiler and cooled by the heat-exchanger faces of the boiler. Thus, in the solution of the present invention, in contrast with the prior art, the circulating gases are not mixed with the combustion air, but they are used expressly for cooling the inert circulating material in the circulating-powder combustion chamber 10. The circulating material mainly consists of inert material, such as sand, fuel ash, limestone and compounds produced in the removal of sulphur. Further, the circulating material containing unburned fuel, so-called residual coke, as a quantity of 1% to 4%.

Thus, in the solution of the invention, expressly the above inert circulating material M is cooled, which circulating material M runs between the furnace and the powder separator 13. The cooling capacity is regulated by regulating the amount of recirculated flue gas. The amount of recirculated flue gas is regulated by regulating the operation of the blower device $P_3$. The flow of flue gas can also be regulated, besides by regulating the blower device $P_3$, by adjusting a regulating damper 21 placed in the flue-gas recirculation duct.

In the solution in accordance with the invention, the circulating gases are not mixed with the combustion air, but they are used for cooling the inert circulating material in the circulating-powder combustion process. Thus, in the solution of the invention, the circulating gases are passed in the process into the space placed after the combustion space B of the circulating-powder combustion chamber 10 (seen in the direction of flow $S_1$ of the flue gases), from where the circulating gases are not combined with the combustion air and, thus, do not affect the combustion process. The circulating gases are preferably brought into the top part of the circulating-powder combustion chamber 10 or directly into the powder separator placed after the top part or into the duct placed between these. It is essential that the circulating gases just cool the circulating material and that, after the cooling, they are made to flow apart out of contact with the circulating material, further into the exhaust-gas boiler and to the heat exchangers.

Figure 2:
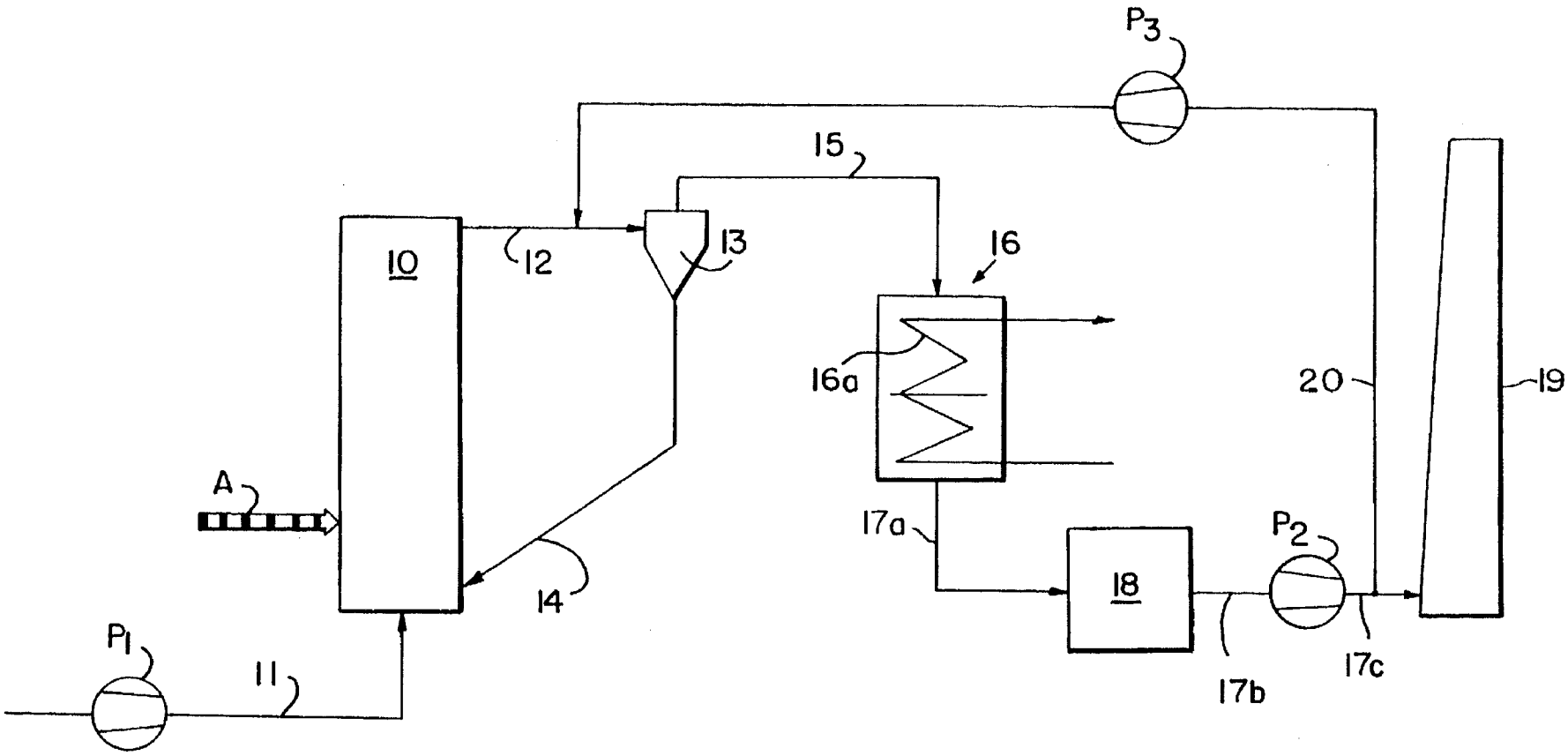
FIG. 2 is a schematic illustration of a second preferred embodiment of the method and the equipment in accordance with the invention.

In the second embodiment of the invention shown in FIG. 2, the fuel A for the circulating-powder combustion chamber 10 of the fluidized-bed boiler is passed into the lower part of the circulating-powder combustion chamber 10. The air needed for the combustion is also passed into the lower part of the circulating-powder combustion chamber 10 by means of the blower device $P_1$ through the duct 11.

From the top part of the circulating-powder combustion chamber 10, a duct 12 passes to a separate powder separator 13, preferably likewise a cyclone separator. By means of the powder separator 13, the fraction with higher powder contents is separated into the duct 14, along which it is passed back to combustion into the lower part of the circulating-powder combustion chamber 10. The flue gas and the fraction with lower contents of powder particles are passed from the powder separator 13 into the duct 15 and further to the exhaust-gas boiler 16, in whose heat exchanger **16*a* a heat-transfer liquid, preferably water, is circulated. Thus, through the heat exchanger, the thermal energy of the exhaust gases is transferred to the liquid circuit of the heat exchanger 16*a*** and further, through the liquid circulation, out of connection with the boiler to useful use.

From the outlet side of the exhaust-gas boiler 16, a duct **17*a* passes to the filter 18. From the filter 18, a duct 17*b*** passes to the blower $P_2$. From the blower $P_2$, from its outlet side, a duct 17*c* passes to the chimney 19.

From the duct 17*c*, according to the invention, a duct 20 is passed as feedback to the circulating material and, in this embodiment, into the duct 12 between the circulating-powder combustion chamber 10 and the powder separator 13.

Thus, also in this embodiment of the invention, the capacity of cooling of the furnace of the circulating-powder combustion chamber is regulated by cooling the inert circulating material of the circulating-powder combustion chamber by means of cold circulating gases taken from the final pan of the boiler and cooled by the heat-exchanger faces of the boiler. Thus, in the solution in accordance with the invention, in contrast with the prior art, the circulating gases are not mixed with the combustion air, but they are used expressly for cooling the circulating material between the top pan of the furnace and the powder separator 13. The cooling capacity is regulated by regulating the amount of recirculated flue gas. The amount of recirculated flue gas is regulated by regulating the operation of the blower device $P_3$.

Figure 3:
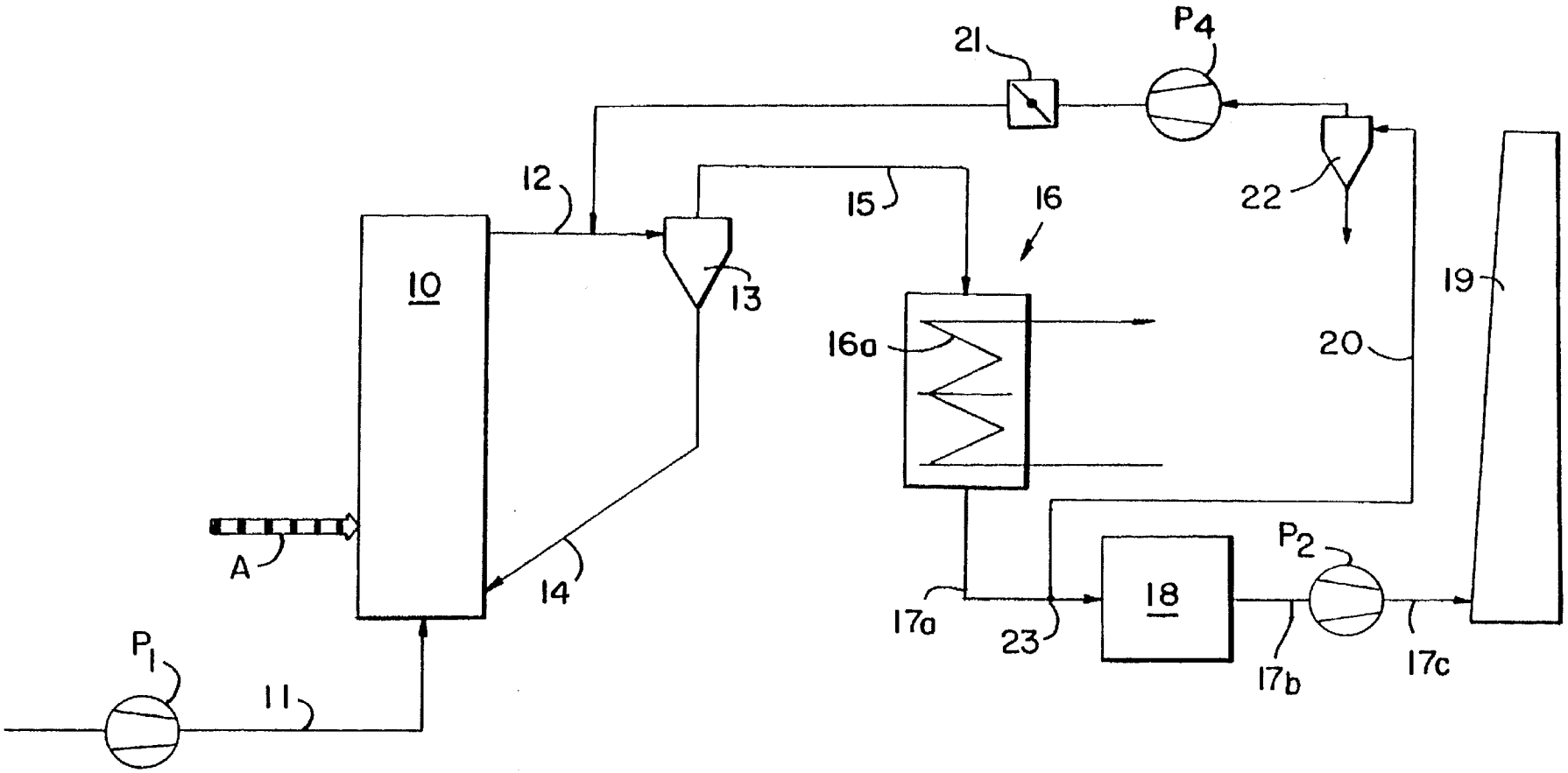
FIG. 3 is a schematic illustration of a third preferred embodiment of the method and the equipment in accordance with the invention.

FIG. 3 shows an embodiment of the invention in which the flue-gas recirculation duct 20 includes a blower $P_4$ operating at an invariable speed of rotation and a regulating damper 21 or equivalent that regulates the amount of recirculation of flue gas. The duct 20 further includes a powder separator 22, which is placed ahead of the blower device $P_4$, seen in the direction of circulation of the flue gas, in which case the faces of the blower device are protected from wear by passing a less contaminated flue gas to the blower $P_4$. The circulating gas is taken from the branch point 23 placed ahead of the filter 18 in the flow direction. In this way, the fine filter 18 does not have to be dimensioned unduly large.

Figure 4:
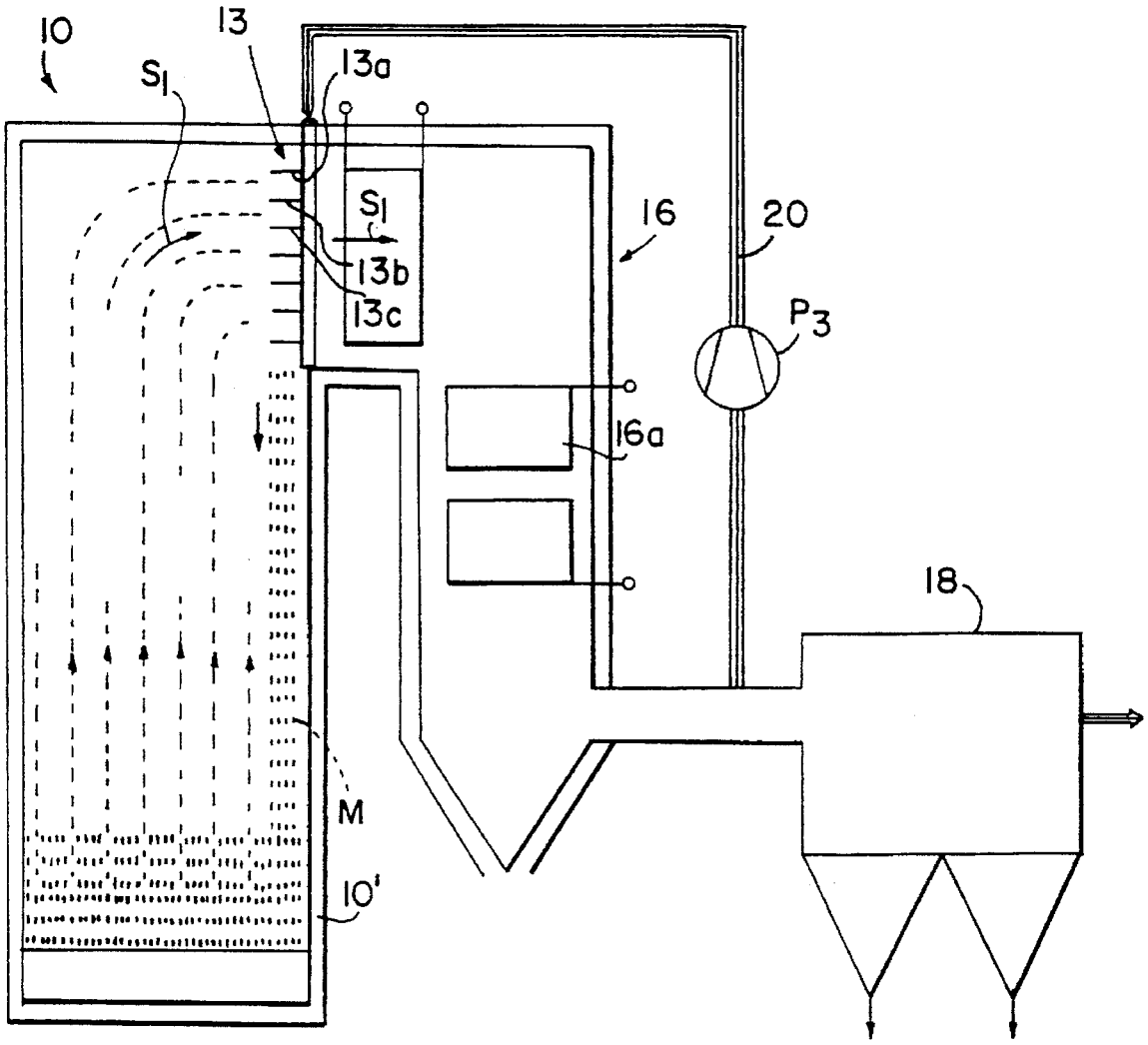
FIG. 4 illustrates a further embodiment of the device in accordance with the invention, wherein the powder separator consists of a number of powder separator units fitted one above the other and placed in the top part of the circulating-powder combustion chamber.

FIG. 4 shows an embodiment of the invention in which the recirculation duct 20 is connected to the duct between the exhaust-gas boiler 16 and the final powder separator 18. The other end of the recirculation duct is connected directly to the powder separator 13. The powder separator 13 comprises a number of powder separator units 13*a*,13*b*,13*c* . . . , which are fitted in the top part of the circulating-powder combustion chamber 10 so that they are placed in the top part of the circulating-powder combustion chamber 10 vertically one above the other and parallel to one side wall 10' of the circulating-powder chamber 10.

FIG. 5 shows one powder separator unit 13*a* on an enlarged scale. The returned circulating gas from the duct 20 is passed along the ducts $D_1$ and $D_2$ into the pipe 23. The pipe 23 contains a second pipe 24 placed centrally in its interior. The circulating gas flows in the space E between the pipes 23 and 24. The circulating gas flows through the guide wings 25 placed on the face of the pipe 24, which wings produce a spiral-shaped run ($S_2$) for the air. The flow of circulating gas blown out of the space between the pipes 23 and 24 further produces a vortex of the circulating material M. The dean flue-gas flow $S_1$ passes centrally through the central pipe 23 further into the exhaust-gas boiler 16 and to the heat exchanger 16*a*. Having been brought into a spiral-shaped rotatory movement by means of the flow $S_1$, by the effect of centrifugal force, the particles in the circulating material M by-pass the orifice F of the duct 23 to the sides and, by the effect of the force of gravity, fall along the walls 10' of the duct down into the furnace.

FIG. 6 shows the pipe construction shown in FIG. 5. The outermost pipe is the pipe 23, and in its interior the pipe 24 is placed centrally. For the flow $S_1$, a flow passage remains between the pipes 23 and 24, and the flow can be made to proceed as spiral-shaped in the way indicated by the arrows $S_2$ by means of the guide wings 25, which have been mounted diagonally in relation to the joint axis of the pipes 23 and 24.

I claim:

1. A method for regulating the temperature of circulating material in a fluidized-bed boiler, comprising the steps of:

introducing powdered fuel into a lower part of a circulating-powder combustion chamber of the fluidized-bed boiler, directing combustion air into the lower part of the combustion chamber to cause combustion of the powdered fuel to generate circulating material comprising a powdered-fuel-containing gas, the circulating material rising to an upper part of the combustion chamber, separating the circulating material into flue gases and unburned powdered fuel in a powder separator, arranging the powder separator in the combustion chamber at a location at which combustion of the powdered fuel has already occurred, directing the unburned powdered fuel along the walls of the boiler into the lower part of the combustion chamber, removing the separated flue gas from the upper part of the boiler, passing the separated flue gases through a heat exchanger to transfer thermal energy from the flue gases to another medium and cool the flue gases, regulating the temperature of the circulating material by mixing the cooled flue gases with the circulating material after the combustion of the powdered fuel and before or during separation of the circulating material in the powder separator such that the cooled flue gases do not mix with the combustion air, said regulation step comprising the step of directing the cooled flue gases directly into the combustion chamber at the powder separator arranged therein such that the inflow of cooled flue gases does not affect the combustion of the powdered fuel, forming the powder separator as a cyclone separator in the combustion chamber by directing the cooled flue gases directly into the upper part of the combustion chamber in a direction tangent to a peripheral wall of the furnace to cause the circulating material to rotate such that the unburned powdered fuel is separated onto walls of the boiler, passing the cooled flue gases from the heat exchanger through a first duct to a chimney, directing a portion of the cooled flue gas from the first duct at a location between the heat exchanger and the chimney into a second duct, blowing the cooled flue gas through the second duct to mix with the circulating material by means of a blower device, and controlling the cooling capacity of the cooled flue gases being mixed with the circulating material by regulating the blower device to regulate the amount of cooled flue gases being blown through the second duct.

2. The method of claim 1, further comprising the steps of:

directing the cooled flue gases from the heat exchanger through a duct to mix with the circulating material, and regulating the amount of cooled flue gases mixing with the circulating material by means of a variable regulating damper arranged in conjunction with the duct.

3. The method of claim 1, further comprising the steps of:

blowing the cooled flue gases from the heat exchanger through a duct to mix with the circulating material by means of a blower device, operating the blower device at a substantially constant speed of rotation such a substantially constant amount of cooled flue gases is blown through the duct, and regulating the amount of cooled flue gases mixing with the circulating material by varying a regulating damper arranged in conjunction with the duct at a location after the blower device in the direction of flow of the cooled flue gases.

4. The method of claim 1, further comprising the step of removing contamination particles from the cooled flue gas by arranging an additional powder separator in the second duct.

5. An apparatus for cooling circulating material in a fluidized-bed boiler having a circulating-powder combustion chamber into which powdered fuel and combustion air are passed to cause combustion of the powdered fuel and generate powdered-fuel-containing gas constituting the circulating material, comprising a powder separator operatively associated with said boiler for separating the circulating material into flue gases and unburned powdered fuel, said powder separator being a cyclone separator arranged in a upper part of said combustion chamber, an exhaust-gas boiler having a heat exchanger, first passage means for passing the flue gases is transferred to another medium and the flue gases are cooled, second passage means for passing at least a portion of the cooled flue gases into the circulating material after the combustion of the powdered fuel and before or during separation of the circulating material in said powder separator such the the cooled flue gases do not mix with the combustion air, said second passage means being structured and arranged to pass the cooled flue gases into said combustion chamber in a direction tangent to a peripheral wall of said boiler to cause rotation of the circulating material such that the unburned powder is separated onto walls of said boiler and flows along said walls into a lower part of boiler and the flue gases is removable from said upper part of said boiler, a chimney for removing the cooled flue gases, third passage means for passing the cooled flue gases from said heat exchanger to said chimney, said second passage means being connected to said third passage means at a location between said heat exchanger and said chimney, and a blower device arranged in conjunction with said second passage means and thus the cooling capacity of the cooled flue gases and the temperature of the circulating material.

6. The apparatus of claim 5, further comprising a blower device arranged in conjunction with said second passage means, said blower device being structured and arranged to blow a substantially constant amount of cooled flue gases through said second passage means, and a regulating damper arranged in said second passage means to regulate the amount of cooled flue gases flowing through said second passage means.

7. The apparatus of claim 5, further comprising an additional powder separator arranged in conjunction with said second passage means at a location before said blower device to remove contamination particles from the cooled flue gases.

8. The apparatus of claim 5, further comprising means for preventing the cooled flue gases from mixing with the combustion air and powdered fuel prior to combustion thereof.

9. The apparatus of claim 8, wherein said means comprise a duct separating said boiler and said powder separator and through which the circulating material is passed.

10. The apparatus of claim 8, wherein said means comprise the positioning of said powder separator within an upper part of said combustion chamber whereby combustion of the powdered fuel and the combustion air occurs in a lower part of said combustion chamber.

11. The apparatus of claim 5, wherein said second passage means are connected to said powder separator, said powder separator comprising powder separator devices arranged in an upper part of said combustion chamber, each of said powder separator units comprising a first, inner pipe, a second, outer pipe surrounding said first pipe and guide wings arranged between said first and second pipes, the cooled flue gas being directed between said first and second pipes and guided by said guide wings such that the separated flue gases are passed through said first pipe to said first passage means and the unburned powdered fuel is directed to walls of sad combustion chamber.

* * * * *